US009680260B2

(12) United States Patent
Fan et al.

(10) Patent No.: US 9,680,260 B2
(45) Date of Patent: Jun. 13, 2017

(54) CABLE CONNECTOR ASSEMBLY WITH IMPROVED GROUNDING STRUCTURE

(71) Applicant: FOXCONN INTERCONNECT TECHNOLOGY LIMITED, Grand Cayman (KY)

(72) Inventors: Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/972,034

(22) Filed: Dec. 16, 2015

(65) Prior Publication Data

US 2016/0172791 A1 Jun. 16, 2016

(30) Foreign Application Priority Data

Dec. 16, 2014 (CN) ..... 2014 2 0793227 U

(51) Int. Cl.

| | |
|---|---|
| ***H01R 9/03*** | (2006.01) |
| ***H01R 13/6585*** | (2011.01) |
| ***H01R 13/6593*** | (2011.01) |
| *H01R 24/62* | (2011.01) |

(52) U.S. Cl.
CPC ..... *H01R 13/6585* (2013.01); *H01R 13/6593* (2013.01); *H01R 24/62* (2013.01)

(58) Field of Classification Search
CPC ..... H01R 13/6585
USPC ..... 439/607.05, 607.34, 607.01, 660
See application file for complete search history.

(56) References Cited

U.S. PATENT DOCUMENTS

| | | | | |
|---|---|---|---|---|
| 6,210,230 | B1 * | 4/2001 | Lai | H01R 9/0518 439/101 |
| 7,175,465 | B1 * | 2/2007 | Tsai | H01R 13/6275 439/352 |
| 7,462,071 | B1 * | 12/2008 | Wu | H01R 9/032 439/497 |
| 8,784,134 | B2 * | 7/2014 | Wu | H01R 13/6598 439/607.05 |
| 8,808,029 | B2 * | 8/2014 | Castillo | H01R 13/6585 439/607.05 |
| 8,851,927 | B2 * | 10/2014 | Hsu | H01R 12/724 439/607.11 |

(Continued)

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

A cable connector assembly including: an electrical connector including an insulative housing, a number of contacts retained in the insulative housing and arranged in two rows apart from each other along a vertical direction, and a latch retained in the insulative housing, wherein the contacts arranged in an upper row include a pair of high-frequency signal contacts and the contacts arranged in a lower row include a pair of high-frequency signal contacts, the two pairs of high-frequency signal contacts disposed relative to each other along the vertical direction; and a cable including a number of wires electrically connected with the contacts of the electrical connector; wherein the electrical connector further includes a grounding plate, the grounding plate including a shielding sheet extending between the two pairs of high-frequency signal contacts.

16 Claims, 11 Drawing Sheets

(56) References Cited

U.S. PATENT DOCUMENTS

| | | | | |
|---|---|---|---|---|
| 8,894,441 | B2 * | 11/2014 | Wu | H01R 13/6598 439/607.01 |
| 8,968,031 | B2 * | 3/2015 | Simmel | H01R 13/659 439/108 |
| 9,437,982 | B2 * | 9/2016 | Wu | H01R 43/20 |
| 2014/0335727 | A1 * | 11/2014 | Lim | H01R 12/724 439/607.01 |
| 2015/0171561 | A1 * | 6/2015 | Little | H01R 24/60 439/607.34 |
| 2015/0171573 | A1 * | 6/2015 | Little | H01R 24/60 439/607.34 |
| 2015/0171574 | A1 * | 6/2015 | Little | H01R 24/60 439/78 |
| 2015/0364871 | A1 * | 12/2015 | Lin | H01R 13/6581 439/607.58 |
| 2016/0013595 | A1 * | 1/2016 | Kao | H01R 13/6591 439/607.55 |

* cited by examiner

CABLE CONNECTOR ASSEMBLY WITH IMPROVED GROUNDING STRUCTURE

BACKGROUND OF THE INVENTION

1. Field of the Invention

The present invention relates to a cable connector assembly, and more particularly to a grounding structure thereof.

2. Description of Related Art

U.S. Pat. No. 7,462,071, issued on Dec. 9, 2008, shows a cable connector assembly including a metal plate, a plurality of contacts arranged in two rows, and a printed circuit board. The contacts include a plurality of grounding contacts and a plurality of signal contacts. The metal plate includes a panel portion and an L-shaped tail portion. The metal plate is positioned between the two rows of contacts. The grounding contacts and the metal plate are electrically connected with conductive pads of the printed circuit board.

The metal plate is a plate-like structure. The metal plate and the grounding contact need to be electrically connected with the printed circuit board independently, resulting in complicated manufacturing process.

An improved cable connector assembly is desired to offer advantages over the related art.

BRIEF SUMMARY OF THE INVENTION

An object of the present invention is to provide a cable connector assembly with an improved grounding structure to enhance grounding effect and high-frequency signal transmission stability.

To achieve the above-mentioned object, a cable connector assembly comprises: an electrical connector including an insulative housing, a number of contacts retained in the insulative housing and arranged in two rows apart from each other along a vertical direction, and a latch retained in the insulative housing, wherein the contacts arranged in an upper row include a pair of high-frequency signal contacts and the contacts arranged in a lower row include a pair of high-frequency signal contacts, the two pairs of high-frequency signal contacts disposed relative to each other along the vertical direction; a cable including a number of wires electrically connected with the contacts of the electrical connector; wherein the electrical connector further includes a grounding plate, the grounding plate including a shielding sheet extending between the two pairs of high-frequency signal contacts.

According to the present invention, the grounding plate has a shielding sheet extending between the two pairs of high-frequency signal contacts, and two grounding plates can reduce the resonance and crosstalk between the high-frequency signal contacts arranged in the upper and lower rows, respectively.

DETAILED DESCRIPTION OF THE INVENTION

Figure 1:
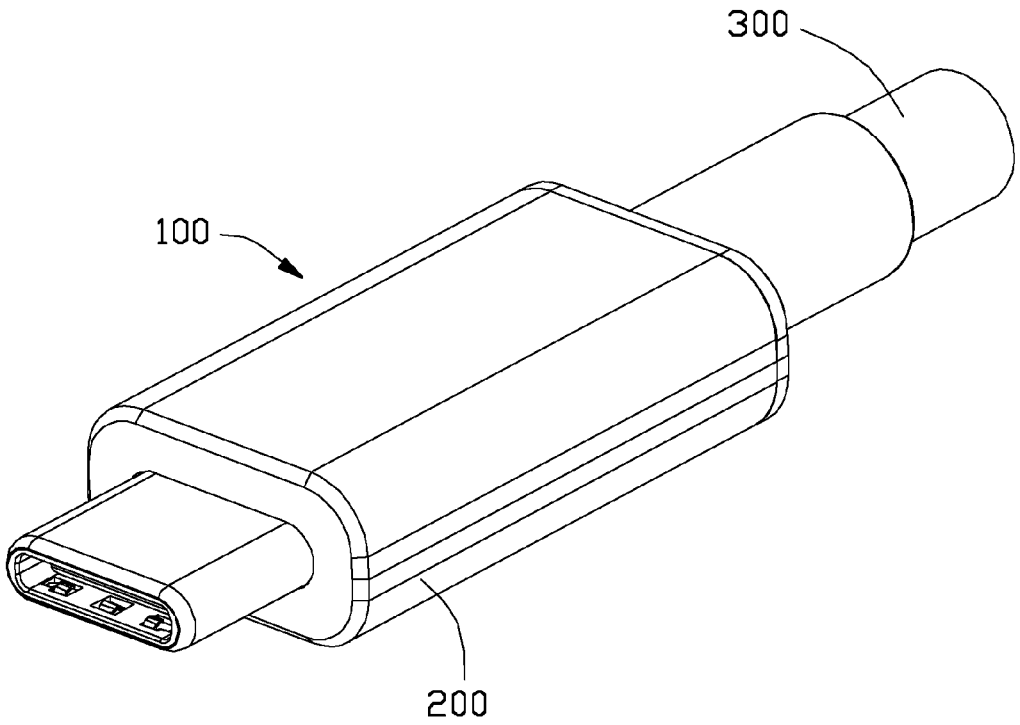
FIG. 1 is a perspective view of a cable connector assembly in accordance with the present invention.
Figure 2:
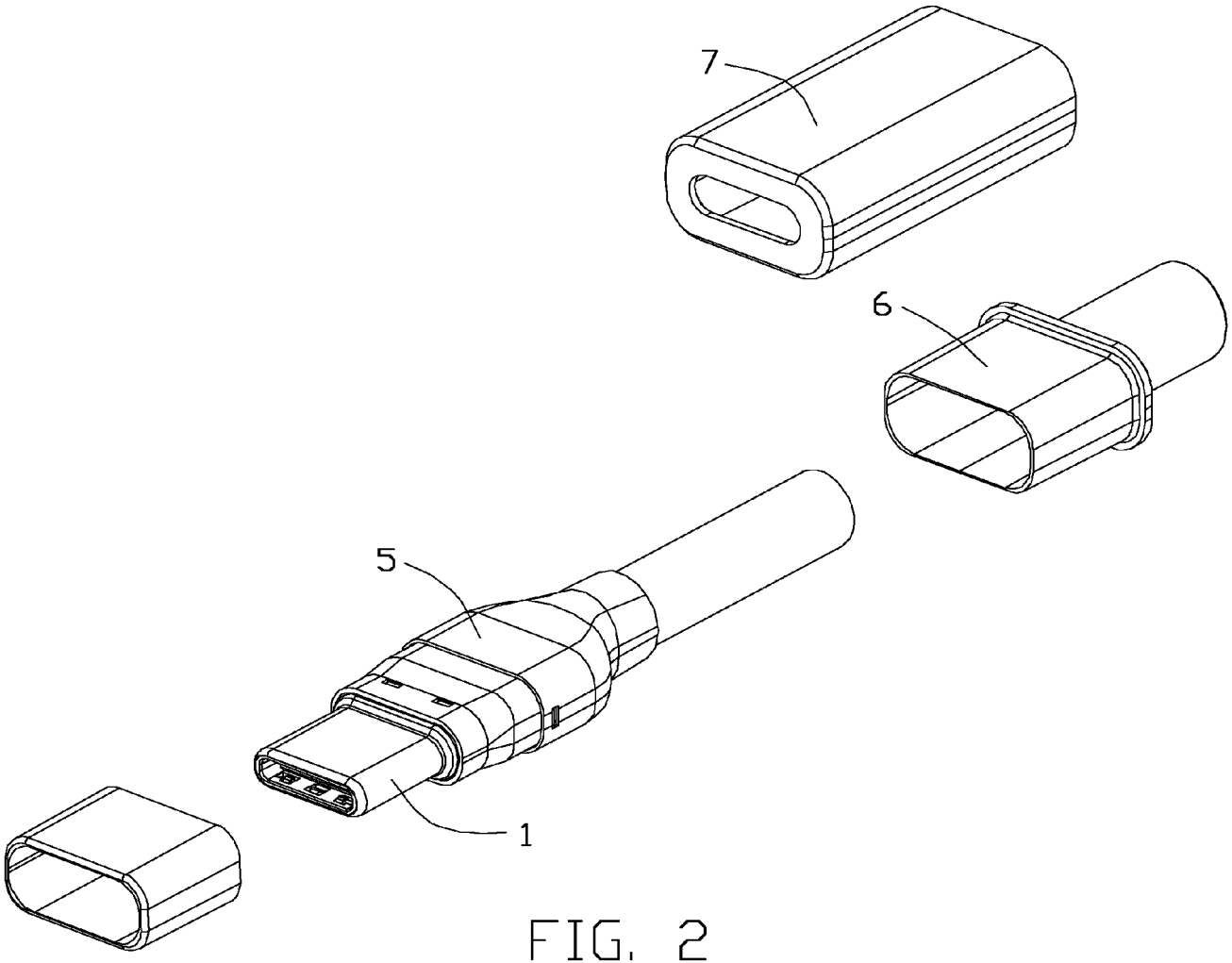
FIG. 2 is a partially exploded view of the cable connector assembly as shown in FIG. 1.
Figure 3:
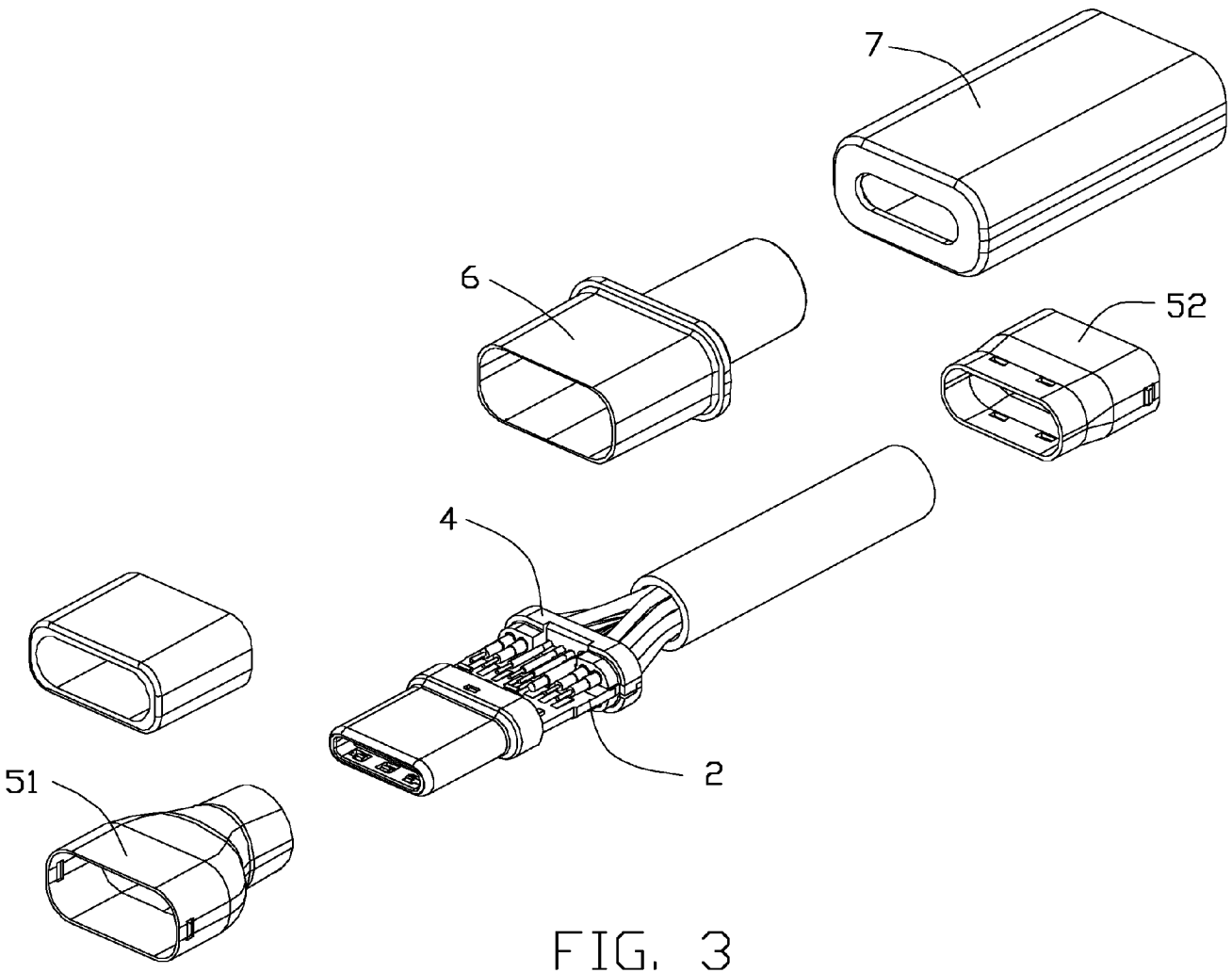
FIG. 3 is another partially exploded view of the cable connector assembly as shown in FIG. 1.

Referring to FIGS. 1 to 3, a cable connector assembly 100 in accordance with the present invention for mating with a mating connector (not shown) comprises an electrical connector 200 and a cable 300 electrically connecting with the electrical connector 200. The electrical connector includes a mating member 1, a printed circuit board (PCB) 2 connected to the mating member 1, a spacer 4 limiting the cable 300, an inner member 5 enclosing part of the cable 300 and the mating member 1, a strain relief 6 molded out of the cable 300 and the inner member 5, and a housing 7 disposed outside. The cable connector assembly 100 can be mated with the mating connector in two different directions to achieve the same function. The electrical connector is a USB type C connector or other connectors compatible with USB 2.0 connectors.

Figure 6:
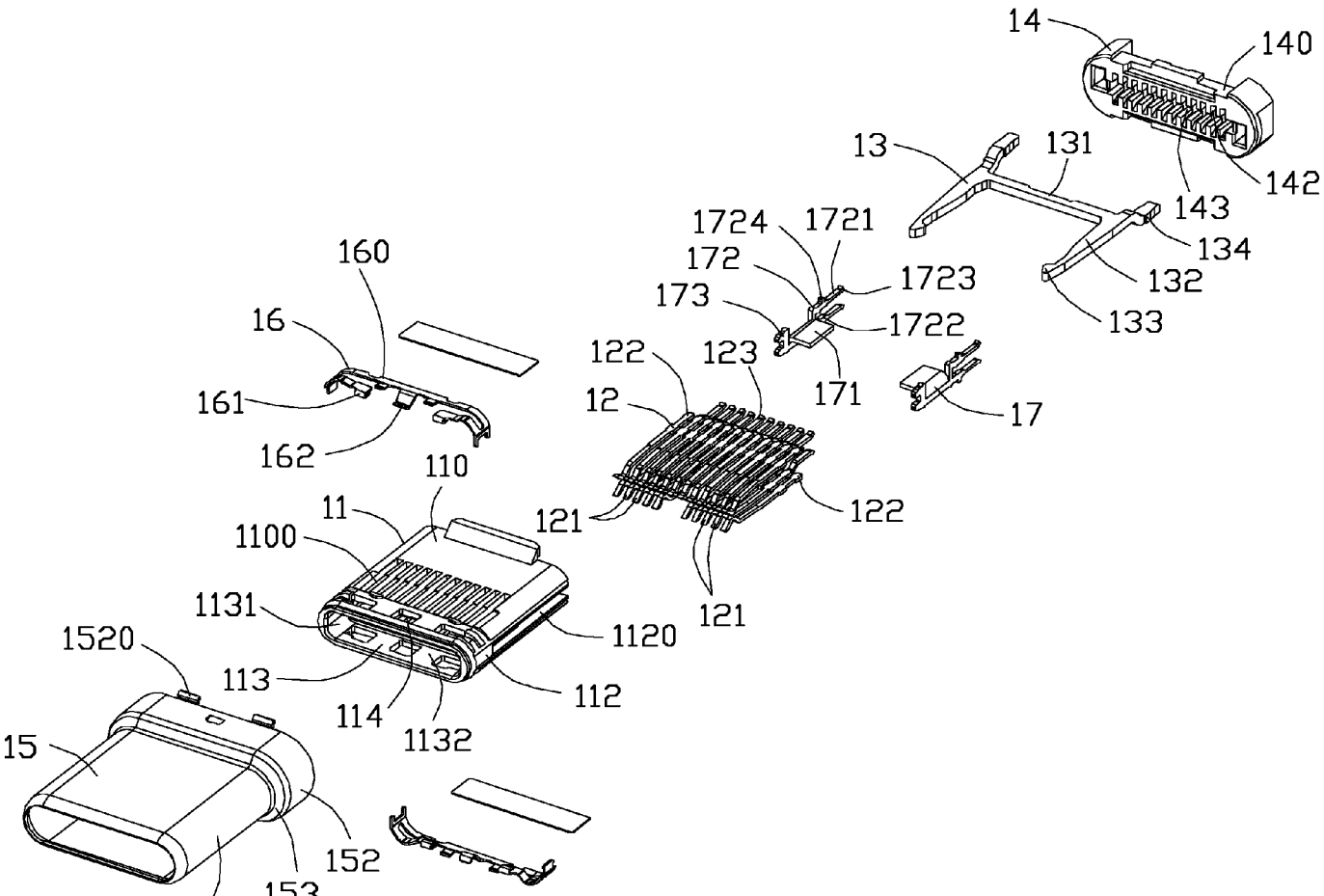
FIG. 6 is an exploded view of the mating member of the cable connector assembly shown in FIG. 3 in accordance with a first embodiment.
Figure 7:
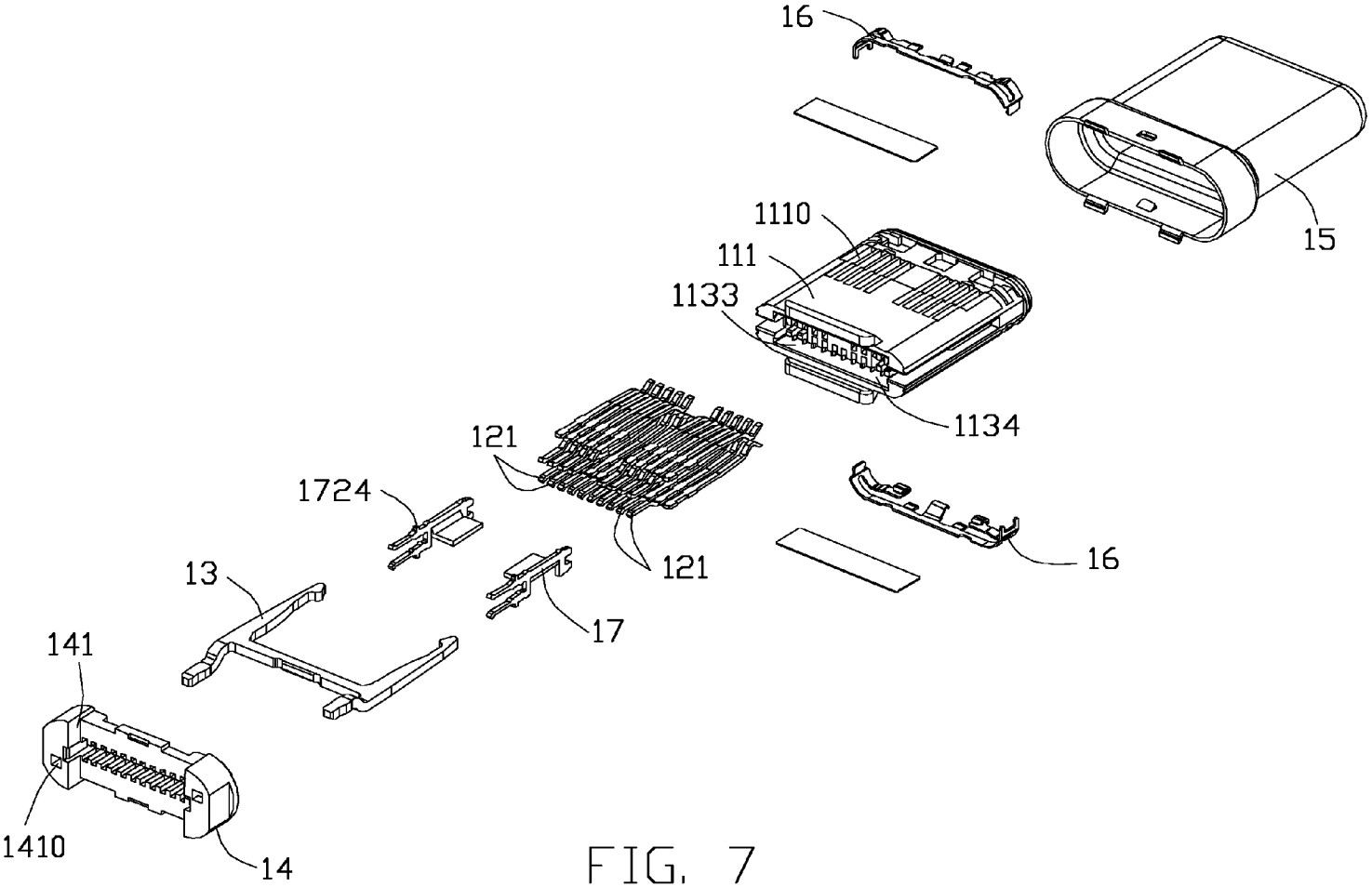
FIG. 7 is an exploded view similar to FIG. 6 but from a different aspect.
Figure 8:
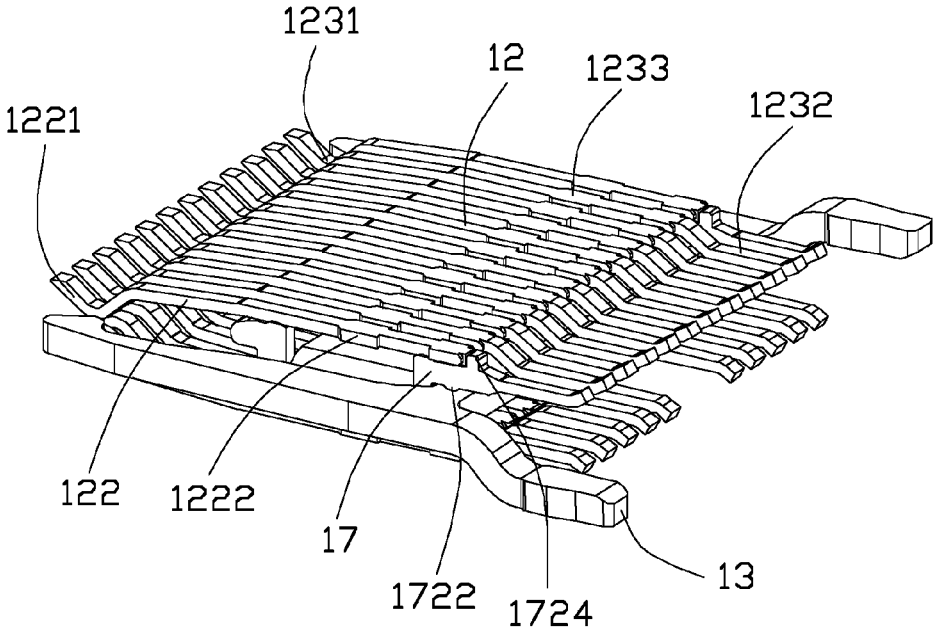
FIG. 8 is a perspective view of the contacts and the latch as shown in FIG. 6.
Figure 9:
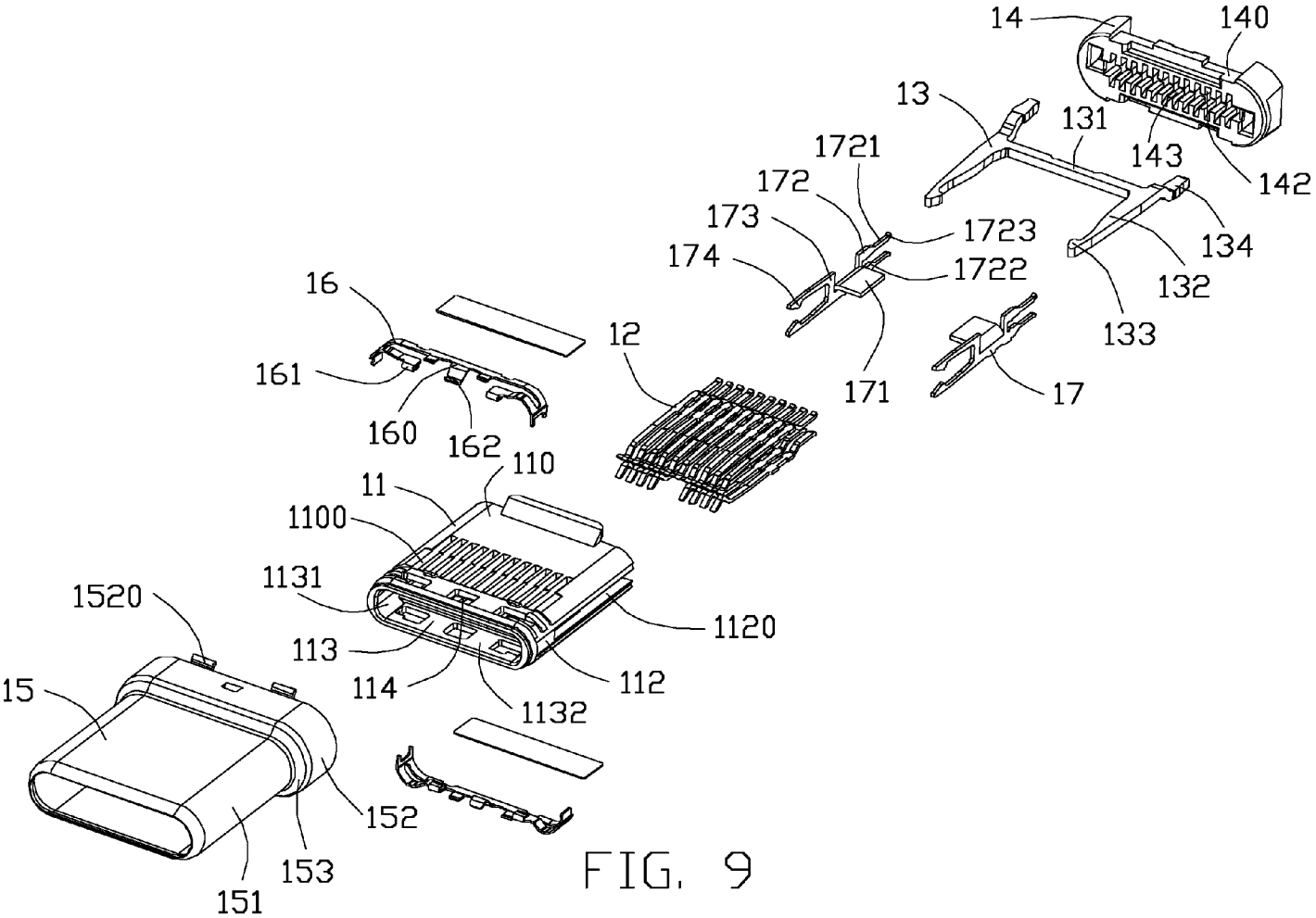
FIG. 9 is an exploded view of the mating member of the cable connector assembly as shown in FIG. 3 in accordance with a second embodiment.
Figure 10:
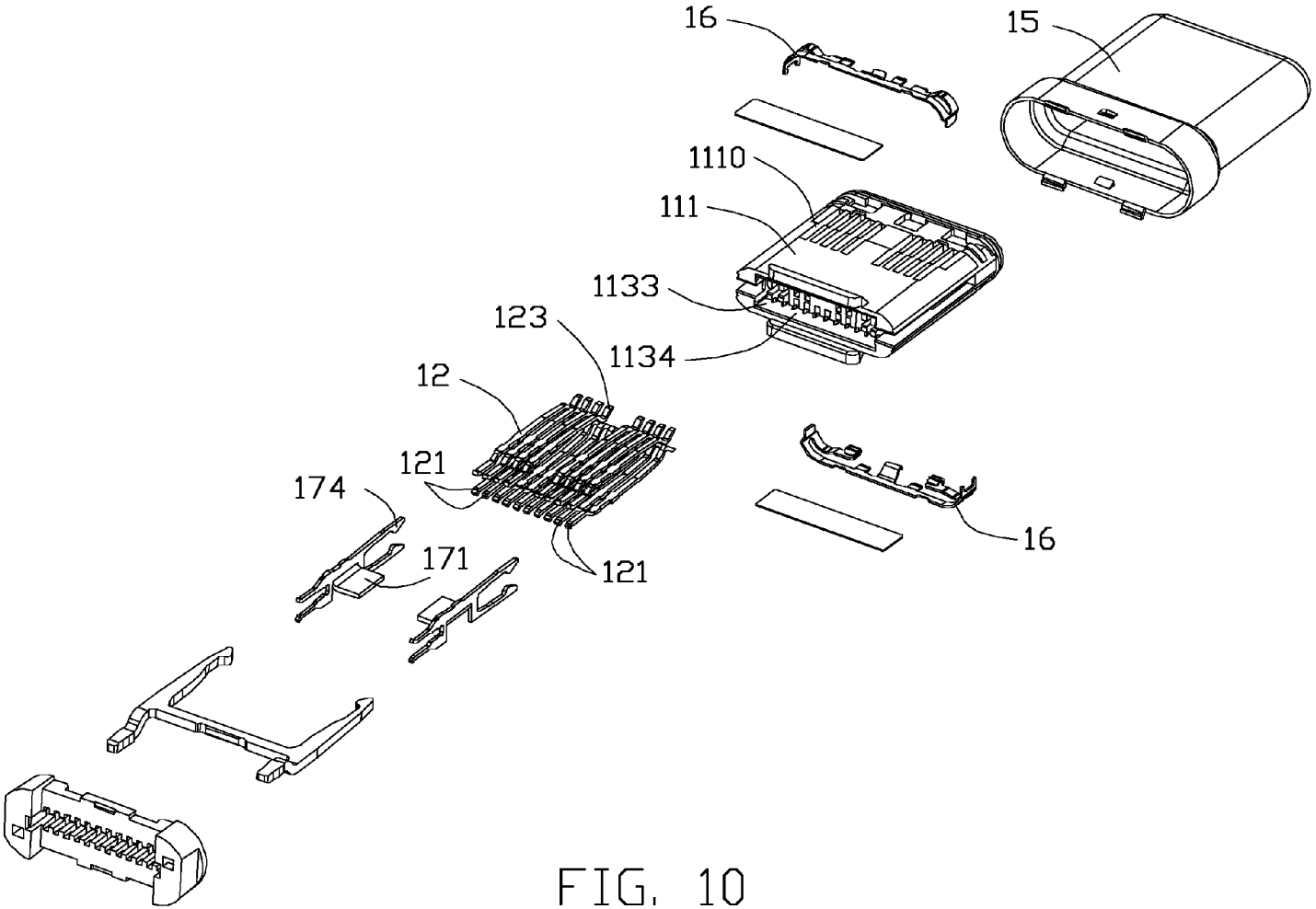
FIG. 10 is an exploded view similar to FIG. 9 but from a different aspect.
Figure 11:
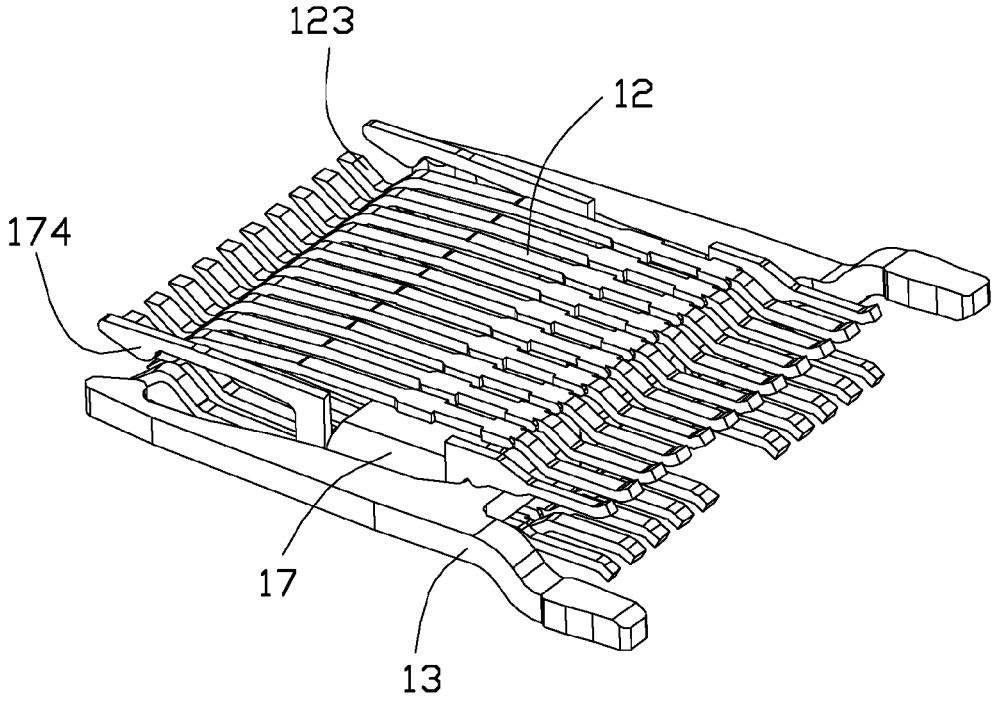
FIG. 11 is a perspective view of the contacts and the latch as shown in FIG. 9.

Referring to FIGS. 6 and 11, the mating member 1 comprises an insulative housing 11, a plurality of conductive terminals or contacts 12 received in the insulative housing 11 and arranged in two rows spaced apart from each other in a vertical direction, a latch 13 disposed between the two rows of conductive terminals 12 for latching with the mating connector, an insulative member 14 disposed behind the insulative housing 11, a metal shell 15 disposed outside of the insulative housing 11 and the insulative member 14, a pair of grounding members 16 disposed on the insulative housing 11 and electrically connected to the metal shell 15, and a pair of grounding plates 17 disposed in the metal shell 15.

The insulative housing 11 comprises a top wall 110, a bottom wall 111 spaced apart from and parallel with the top wall 110, a pair of side walls 112 connecting the top wall 110 and the bottom wall 111, and a receiving room 113 surround by the top, bottom, and side walls 110,111,112. The receiving room 113 is divided into a front portion 1132 having a front opening 1131, and a rear portion 1134 having a rear opening 1133. The top wall 110 defines a top recess 1100 in communication with the front portion 1132. The bottom wall 111 defines a bottom recess 1110 in communication with the front portion 1132. Each of the side walls 112 defines a side recess 1120 extending forwardly from a rear end of the insulative housing 11 but not through a front end of the insulative housing 11. The side recesses 1120 are in communication with the front portion 1132 and the rear portion 1134 of the receiving room 113. Each of the top and bottom walls 110,111 defines a number of slots 114 on a front end thereof.

The contacts 12 arranged in a top row include two pairs of high-frequency signal contacts 121. The contacts 12 arranged in a bottom row include two pairs of high-frequency signal 121. Two pairs of high-frequency signal contacts 121 respectively disposed in different rows are aligned in the vertical direction. Another two pairs of high-frequency signal contacts 121 are aligned in the vertical direction. The grounding plate 17 includes a shielding sheet 171 extending inwardly to locates between the two pairs of high-frequency signal contacts aligned with each other, a fixing portion 172 rearwardly extended form a rear end of the shielding sheet 171 and a connection portion 173 forwardly extended from a front end of the shielding sheet 171. The fixing portion 172 is to fixed on the latch 13. The fixing portion 172 includes a pair of fixing arms 1721 opposite to each other. Each of the fixing arms 1721 defines a convex portion 1722 relatively to ensure the grounding member 17 in close contact with the latch 13. A solder portion 1723 is extended from a rear end of each fixing arms 1721 to be soldered on the printed circuit board 2. The grounding plates 17 can reduce the resonance and crosstalk between the high-frequency signal contacts 121.

In the present embodiment, the contacts 12 includes a pair of grounding contacts 122 aligned witch each other in a vertical direction and a number of first contacts 123. Each of the grounding contacts 122 includes a mating potion 1221 and a middle portion 1222 rearwardly extended from a rear end of the mating portion 1221. Each of the first contacts 123 includes a front portion 1231 extending into the insulative housing 11, a rear portion 1232 rearwardly extended, and a mounting portion 1233 defined between the front portion 1231 and the rear portion 1232 and fixed on the insulative housing 11. The front portion 1231 is to mate with the mating connector electrically. The rear portion 1232 is soldered on the printed circuit board 2. The front portions 1231 of the first contacts 123 located in a top row and a bottom row are defined face to face. The first contacts 123 include power contacts, grounding contacts, spare contacts and detect contacts. A projecting block 1724 is extended from each fixing arms 1721. A top end of the middle portion 1222 of the grounding contacts 122 is bent against with the projection block 1724. The middle portion 1222 is contacted with the connection portion 173 of the grounding plate 17.

In another embodiment, the contacts 12 includes high-frequency signal 121 and first contacts 123. The grounding plate 17 includes a docking potion 174 extending form a front end of the connection portion 173. The docking portions 174 are arranged side by side with the front potion 1231 of the first contacts 123. In the present embodiment, grounding contacts are unnecessary to be defined, the front end of the connection portion 173 of the grounding plate 17 is extended to form a grounding contact 122.

The latch 13 comprises a base portion 131 extending along a transverse direction, a pair of latch beams 132 respectively extending forwardly from two opposite ends of the base portion 131, a latch portion 133 extending from a front end of each latch beam 132 along a face to face direction and a pair of extension arms 134 extending from rearwardly from tow opposite ends of the base portion 131 along a opposite direction compared to the latch beam 132. A extension arm 134 on a side is in a pane lower than the plane of the base portion 131, another extension arm 134 on another side is in a plane higher than the plane of the base portion 131. The latch 13 is mounted into the insulative housing 11 through the rear opening 1133 of the rear portion 1134 of the receiving room 113. The latch beams 132 are received into the corresponding side recesses 1120, respectively. At least a portion of each of the latch portions 133 projects into the front portion 1132 of the receiving room 113. The pair of latch portions are arranged face to face along the transverse direction.

The insulative member 14 cooperates with the insulative housing 11 to fix the latch 13. The insulative member 14 comprises an insulative base portion 140, a pair of extending portions 141 extending rearwardly from two opposite ends of the insulative base portion 140, two rows of through holes 142 spaced apart in the vertical direction and extending through the insulative base portion 140 along a front to rear direction and a receiving slot 134 defined between the two rows of through holes 142. The receiving slot 134 is in communication with the through holes 142. Each of the extending portions 141 defines a mounting slot 1410 extending along a rear to front direction. The insulative member 14 is mounted to the insulative housing 11 along a rear to front direction. The contacts 12 are inserted into the corresponding through holes 142. The base portion 131 of the latch 13 is received into the receiving slot 143 of the insulative member 14, and the pair of extension arms 134 is received in the corresponding mounting slot 1410.

The metal shell 15 has a closed circumference that has a good seal performance, a good anti-EMI performance, etc. The closed circumference of the metal shell 15 could be manufactured by drawing a metal piece, bending a metal piece, die casting, etc. The metal shell 15 comprises a first front end 151 for being inserted into the mating connector, a first rear end 152, and a first transition portion 153 for connecting the first front end 151 and the first rear end 152. The shape of the first rear end 152 is consistent with the inslulatvie member 14. A diametrical dimension of the first front end 151 is smaller than the diametrical dimension of the first rear end 152. The first rear end 152 comprises a pair of latch tabs 1520 projecting outwardly.

A grounding members 16 is received on the top recess 1110, and the other one is received on the bottom recess 1110. Each of the grounding members 16 comprises a flat body portion 160, a pair of elastic sheets 161 extending from two opposite ends of the flat body portion 160 and toward the insulative housing 11 for being attached to the insulative housing 11, a plurality of front grounding tabs 162 extending forwardly from a front side of the flat body portion 160 and entering into the front portion 1132 of the receiving room 113. The elastic sheets 161 and the front grounding tabs 162 are received in the corresponding slots 114. The grounding tabs 162 are used for mating with the mating connector. The front grounding tabs 162 of the pair grounding members 16 are disposed face to face along the vertical direction. A distance along the vertical direction between the front grounding tabs 162 of the pair of grounding members 16 is greater than a distance along the vertical direction of the front portions 1231 of the two rows of contacts 12.

Figure 4:
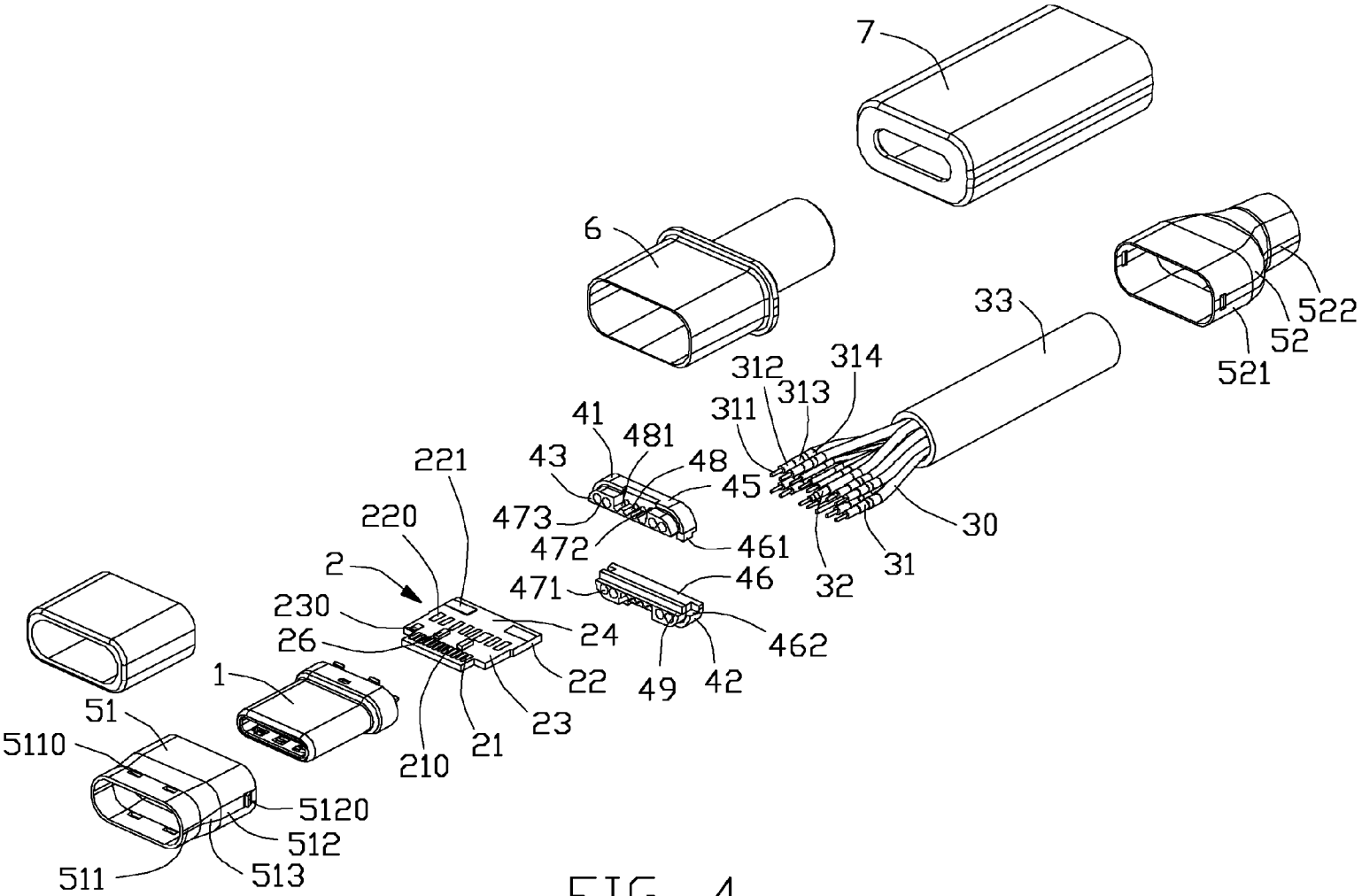
FIG. 4 is a partially exploded view of the cable connector assembly as shown in FIG. 1 omitting a mating member thereof.
Figure 5:
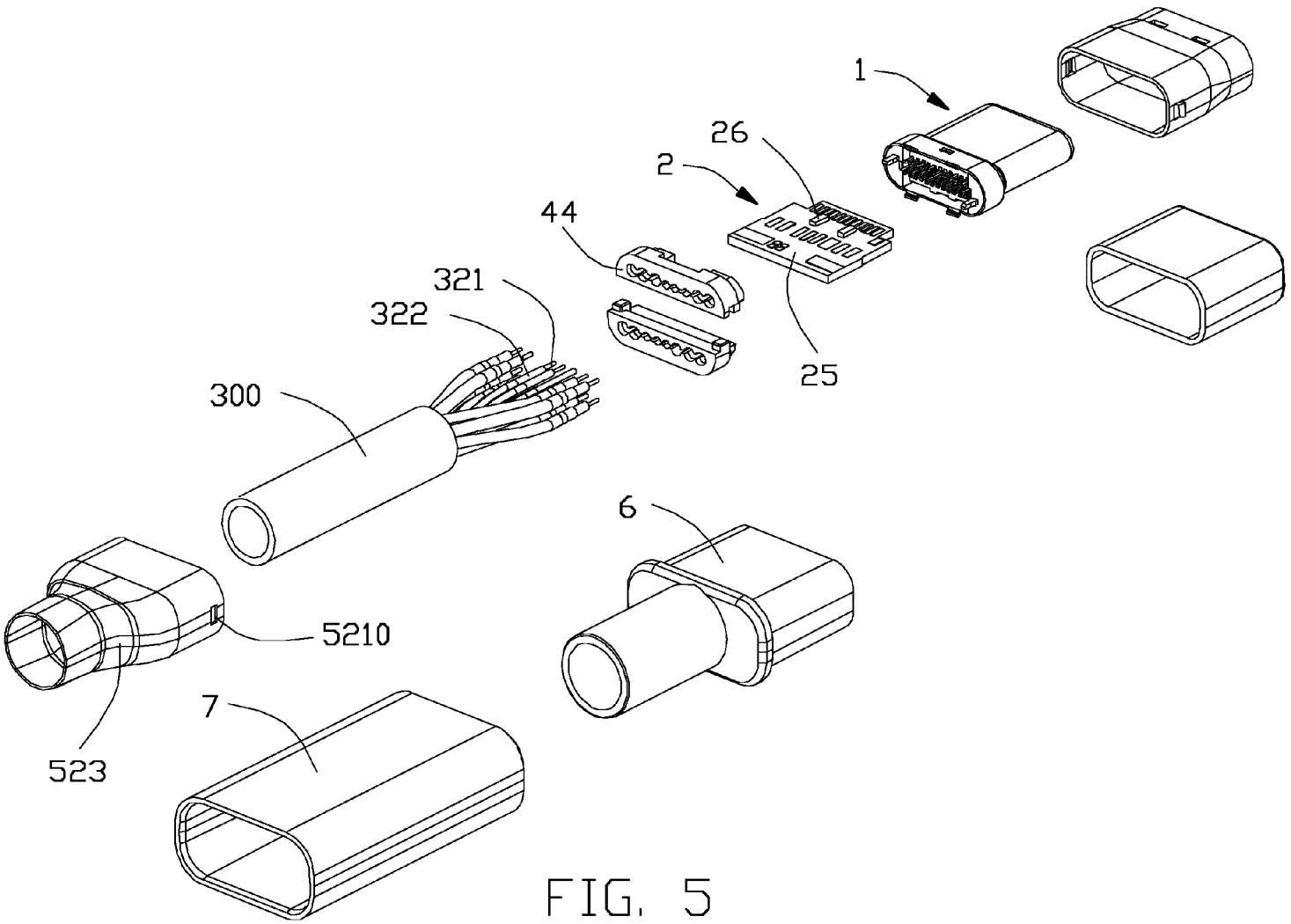
FIG. 5 is a partially exploded view of the cable connector assembly similar to FIG. 4 but from a different aspect.

Referring to FIGS. 4 and 5, the PCB 2 is disposed between the mating member 1 and the cable 300. The cable 300 is electrically connected with the contacts 12 by the PCB 2. The PCB 2 comprises a front end portion 21, a rear end portion 22, and a middle portion 23 connecting the front end portion 21 and the rear end portion 22. The PCB 2 comprises an upper surface 24 and an opposite lower surface 25. The upper and the lower surface of the front end portion 21 comprise a plurality of front conductive pads 210 connected with the rear portion 1232 of the contacts 12, while the upper and the lower surface of the rear end portion 22 comprise a plurality of rear conductive pads 220 connected to the cable 300. A metal or grounding bar 221 is disposed behind the rear conductive pads 220 on the upper surface 24. The lateral dimension of the front end portion 21 is smaller than the rear end portion 22. The spacing between the adjacent front conductive pads 210 is smaller than the spacing between the adjacent rear conductive pads 220. The lateral dimension of the front conductive pads 210 is greater than the lateral dimension of the rear conductive pads 220. The number of the front conductive pads 210 is more then the number of the rear conductive pads 220. A metal sheet 230 is defined on each of the upper and lower surface 24,25 of the a middle portion 23 to be soldered with the extension arms 134 of latch 13. The front end portion 21 is disposed between the rear portions 1232 of the two rows of contacts 12, and the rear potions 1232 are electrically connected with the corresponding front conductive pads 210. A number of electronic components are set on the PCB 2.

The cable 3 has a sheath 33 that contains a plurality of coaxial wires 31 and a plurality of single wires 32. At least one of the upper and lower surface 24,25 solders a number of coaxial wires 31 and number of single wires 32 side by side and adjacent to the coaxial wires 31. Each coaxial wire 31 comprises a first inner conductor 311, an inner insulative layer 312 enclosing the first inner conductor 311, a metal braided layer 313 enclosing the inner insulative layer 312, and an outer insulative layer 314 enclosing the metal braided layer 313. Each metal braided layer 313 of the coaxial wires 31 is soldered with the metal bar 221. Each single wire 32 comprises a second conductor 321 and an outer jacket 322 enclosing the second conductor 321. The single wires 32 are soldered on central position of the PCB 2, while the coaxial wires 31 are soldered on central potion outside position of the PCB 2.

In this embodiment, the spacer 4 comprises an upper half 41 limiting the wires 31, 32 on the upper surface 24 and a lower half 42 mounted to the upper half 41 for limiting the wires 31, 32 on the lower surface 25. The spacer 4 also can be disposed in one piece in other embodiments. Each of the upper half 41 and the lower half 42 comprises a front wall 43 proximal to the PCB 2, an opposite rear wall 44, and an upper wall 45 and a lower wall 46 connecting the front wall 43 and the rear wall 44. The spacer 4 comprises a plurality of first positioning holes 471 passing through the front wall 43 and the rear wall 44 for locating the coaxial wires 31, a plurality of second positioning holes 472 passing through the front wall 43 and the rear wall 44 for locating the signal wires 32, and a number of spacing wall 473 between the adjacent positioning holes. The spacing wall 473 extends from the front wall 43 to the rear wall 44. A portion 48 is defined in communication with the second positioning holes 472 and through the front wall 43 and the rear wall 44 along a front-to-rear direction. The signal wires 32 are bent to be received in the portion 48 for preventing the signal wires 32 from being injured when working the coaxial wires 31. Each of the upper half 41 and the lower half 42 includes a portion 48, the first positioning holes 471, and the second positioning holes 472. An upper hollow of the portion 48 forms a limiting groove 481 to limit the movement along a left and right direction of the signal wires 32. A fixing slot 49 is defined on a front end of the spacer 4 to fix the PCB 2. The lower wall 46 of one of the upper and lower halves 41 and 42 forms a pair of lugs 461 on opposite ends thereof, respectively, and the lower wall 46 of another of the upper and lower halves 41 and 42 forms a pair of receiving holes 462 to receive corresponding lugs 461.

The inner member 5 comprises a first member 51 and a second member 52. The first member 51 has a closed circumference that has a good seal performance, a good anti-EMI performance, etc. The closed circumference of the first member 51 could be manufactured by drawing a metal piece, bending and forming a metal piece, die casting, etc. The first member 51 comprises a second front end 511 telescoped with a rear end of the mating member 1, a second rear end 512 opposite to the second front end 511, and a second transition portion 513 between the second front and rear ends 511,512. The diametrical dimension of the second front end 511 is larger than the diametrical dimension of the second rear end 512. The second front end 511 defines a pair of latch holes 5110 latched with the latch tabs 1520 of the metal shell 15, when the second member 51 is telescoped on an outer side of the first rear end 152 of the metal shell 15. The second rear end 512 defines fixing blocks 5120 on opposite sides thereof The second front end 511 of the first member 51 is interference fit with the first rear end 152 of the metal shell 15, thus, the first member 51 is fit with the metal shell 15 tightly, and achieving a good Anti-electromagnetic interference performance on the engagement portion between them. The second front end 511 of first member 51 and the first rear end 152 of the metal shell 15 are further connected by laser welding in some spots or full circumference to have a good strength.

The second member 52 has a closed circumference that has a good seal performance, a good anti-EMI performance, etc. The closed circumference of the second member 52 could be manufactured by drawing a metal piece, bending and forming a metal piece, die casting, etc. The second member 52 comprises a main portion 521 telescoped with the second rear end 512 of the first member 51, a ring portion 522 telescoped and crimped with the cable 300, and a third transition portion 523 between the main portion 521 and the ring portion 522. The diametrical dimension of the main portion 521 is larger than the diametrical dimension of the ring portion 522. In assembling, firstly, the second member 52 is telescoped on the cable 300. The second member 52 is moved forwardly and telescoped on the spacer 4, after the wires 31 and 32 are soldered on the rear conductive pads 220. The main portion 521 defines retaining holes 5210 on the opposite side thereof The second member 52 is forwardly moved beyond the spacer 4 to latch with the second rear end 512 of the first member 51, the fixing block 5120 is received and fixed in the corresponding retaining holes 5210. The main portion 521 is telescoped on the outside of the second rear end 512, and so the dimension of the main portion 521 is greater, to avoid interference with the cable 300. The main portion 521 is interference fit with the second rear end 512, thus, the second member 52 is fit with the first member 51 tightly, and achieving a good Anti-electromagnetic interference performance on the engagement portion between them. The main portion 521 and the second rear end 512 of the first member 51 are further connected by spot laser welding to have a good strength. The ring portion 522 is telescoped on the outside of the cable 300 and riveted with the cable 300.

To assemble the cable connector assembly: firstly, the contacts 12 are provided to be inserted into the insulative housing 11, the grounding plate 17 is inserted into the insulative housing 11 and connected with the contacts 12, the latch is assembled into the insulative house to fixed with the grounding plate 17, the grounding member 16 and the insulative member 14 are assembled with the insulative housing 11, and the insulative housing 11 is mounted in the metal shell 15 to form the mating member 1; the PCB 2 is inserted into the mating member 1, the extension arms 134 are soldered with the metal pads, and the strain relief 6 is molded on the metal sheets 230 of the PCB 2; the cable 300 is further provided, the cable 300 includes a number of coaxial wires 31 and a number of signal wires 32, and the coaxial wires 31 are handled for more times than the signal wires 32; the spacer 4 is further provided, the spacer 4 includes an upper half 41 and a second half 42; the coaxial wires 31 are passed through the first positioning holes 471, and the signal wires 32 are passed through the second positioning holes 472, the rear end of the cable 300 extending from the positioning holes is fixed on the spacer using glue; the signal wires 32 are bent to be received in the portion 48, and the coaxial wires 31 are processed firstly. In the present embodiment, the cutting is by laser, but in other embodiment, the wires can be processed by other methods. The outer insulative layer 314 is cut to expose the metal braided layer 313 of the coaxial wire 31 firstly, then the metal braided layer 313 is further cut to expose the inner insulative layer 312. The bent signal wires 32 are restored; the coaxial wires 31 and the signal wires 32 fixed on the upper half 41 are cut simultaneously to remove the inner insulative layer 312 to expose the first inner conductor 311, the outer jacket 322 is removed to expose the second inner conductor 321; the coaxial wires 31 and the signal wires 32 fixed on the lower half 42 are cut simultaneously to expose the first inner conductor 311 and the second inner conductor 321; the cable 300 is soldered with the PCB 2; the first inner conductor 311 is soldered with the rear conductive pads 220 on the upper surface 24 of the PCB 2, the metal braided layer 313 is soldered with the metal bar 221, and the second inner conductive 321 is soldered with the rear conductive pads 220 on the lower surface 25 of the PCB 2.

The inner mold 5 encloses at least a portion of the mating member 1 and a portion of the cable 300.

The strain relief 6 is molded on at least a portion of the inner mold 5 and a portion of the cable 300.

The housing 7 is sleeved on the inner mold 5 and the strain relief 6 and fixed by glue, thus the cable connector assembly is assembled completely. The sequence of assembling the cable connector assembly 100 can be changed according to needs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an electrical connector including an insulative housing, a number of contacts retained in the insulative housing and arranged in two rows apart from each other along a vertical direction, and a latch retained in the insulative housing, wherein the contacts arranged in an upper row include a pair of high-frequency signal contacts and the contacts arranged in a lower row include a pair of high-frequency signal contacts, the two pairs of high-frequency signal contacts disposed relative to each other along the vertical direction; and a cable including a number of wires electrically connected with the contacts of the electrical connector; wherein the electrical connector further includes a grounding plate, the grounding plate including a shielding sheet extending between the two pairs of high-frequency signal contacts;

the two pairs of high-frequency signal contacts in the upper and lower rows are aligned with each other along a vertically direction;

the grounding plate includes a fixing portion rearwardly extending from a rear end of the shielding sheet and a connection portion forwardly extending from a front end of the shielding sheet, and the fixing portion is fixed with the latch; and the fixing portion of the grounding plate includes a pair of fixing arms opposite to each other, each of the fixing arms defining a convex portion to make the grounding plate in close contact with the latch.

2. The cable connector assembly as recited in claim 1, further including a printed circuit board, and wherein a solder portion is extended from a rear end of each fixing arm to be soldered on the printed circuit board.

3. The cable connector assembly as recited in claim 2, wherein the contacts include a number of grounding contacts aligned with each other along the vertical direction, each of the grounding contacts includes a mating potion and a middle portion rearwardly extended from a rear end of the mating portion, and the middle portion of the grounding contacts is contacted with the connection portion of the grounding plate.

4. The cable connector assembly as recited in claim 3, wherein the fixing portion of the grounding plate extends to form a projecting block, and a top end of the middle portion of the grounding contacts presses against the projection block.

5. The cable connector assembly as recited in claim 2, wherein the grounding plates includes a docking potion extending from a front end of the connection portion.

6. The cable connector assembly as recited in claim 2, wherein the contacts arranged in the upper row include two pairs of high-frequency signal contacts, the contacts arranged in the lower row include two pairs of high-frequency signal contacts, one of the two pairs of the high-frequency signal contacts arranged in the upper row is aligned with one of the two pairs of the high-frequency signal contacts arranged in the lower row, another of the two pairs of the high-frequency signal contacts arranged in the upper row is aligned with another of the two pairs of the high-frequency signal contacts arranged in the lower row, there are two grounding plates each includes a shielding sheet positioned between the aligned pairs of the two pairs of high-frequency signal contacts arranged in the upper and lower rows.

7. The cable connector assembly as recited in claim 2, wherein the latch includes a base portion positioned between the contacts arranged in the upper and lower rows and a pair of latch beams respectively extending forwardly from two opposite ends of the base portion.

8. An electrical connector comprising:

an insulative housing forming therein a plurality of upper passageways and a plurality of lower passageways spaced from each other in a vertical direction, each of said upper passageways and said lower passageways extending along a front-to-back direction perpendicular to said vertical direction;

a plurality of resilient upper contacts disposed in the corresponding upper passageways, respectively, said upper contacts including two opposite pairs of upper differential pair and a pair of upper grounding contacts; and a plurality of resilient lower contacts disposed in the corresponding lower passageways, respectively, said lower contacts including two opposite pairs of lower differential pair and a pair of lower grounding contacts;

a pair of discrete grounding plates located around two opposite ends of the housing in a transverse direction perpendicular to both said vertical direction and said front-to-back direction; wherein each of said grounding plates is stamped from metal sheet and extends in a vertical plane and further unitarily includes a horizontal shielding sheet in a horizontal plane to isolate the corresponding upper differential pair and lower differential pair in the vertical direction; and each of said grounding plates is aligned with a corresponding upper grounding contact and a corresponding lower grounding contact in the vertical direction.

9. The electrical connector as claimed in claim 8, wherein said upper grounding contact and said lower grounding contact are unitarily formed with said grounding plate.

10. The electrical connector as claimed in claim 8, wherein said upper grounding contact and said lower grounding contact are discrete from the grounding plate in an abutment manner.

11. The electrical connector as claimed in claim 8, further including a metal latch mechanically and electrically connected to the grounding plate.

12. The electrical connector as claimed in claim 8, wherein said grounding plate includes a tail section to connect to a printed circuit board on which tails of the upper contacts and lower contacts are connected.

13. An electrical connector comprising:

an insulative housing forming therein a plurality of upper passageways and a plurality of lower passageways spaced from each other in a vertical direction, each of said upper passageways and said lower passageways extending along a front-to-back direction perpendicular to said vertical direction;

a plurality of resilient upper contacts disposed in the corresponding upper passageways, respectively, said upper contacts including two opposite pairs of upper differential pair; and a plurality of resilient lower contacts disposed in the corresponding lower passageways, respectively, said lower contacts including two opposite pairs of lower differential pair;

a pair of grounding plates located around two opposite ends of the housing in a transverse direction perpendicular to both said vertical direction and said front-to-back direction; wherein each of said grounding plates is stamped from metal sheet and includes a horizontal shielding sheet in a horizontal plane to isolate the corresponding upper differential pair and lower differential pair in the vertical direction, and forms a pair of tail sections commonly sandwich a printed circuit board to which tails of said upper contacts and said lower contacts are connected.

14. The electrical connector as claimed in claim 13, further including a metallic latch mechanically and electrically connected to the grounding plate, wherein said latch includes a tail mechanically and electrically connected to the printed circuit board.

15. The electrical connector as claimed in claim 14, wherein each of said grounding plates forms a pair of resilient arms functioning as an upper grounding contact of said upper contacts and a lower grounding contact of said grounding contacts.

16. The electrical connector as claimed in claim 14, wherein the upper contacts include an upper grounding contact and the lower contacts include a lower grounding contact commonly aligned with and sandwich the corresponding grounding plate in the vertical direction.

* * * * *